United States Patent [19]

Cavazza

[11] 3,968,872

[45] July 13, 1976

[54] DEVICE, PROVIDED WITH A PUNCHER AND A DRIPPER, FOR THE HERMETIC SEALING OF CONTAINERS

[75] Inventor: Claudio Cavazza, Rome, Italy

[73] Assignee: Sigma-Tau, Italy

[22] Filed: Aug. 2, 1974

[21] Appl. No.: 494,375

[30] Foreign Application Priority Data

Aug. 3, 1973 Italy ..... 51818/73

[52] U.S. Cl. ..... 206/222; 128/218 M; 215/309; 222/83

[51] Int. Cl.[2] ..... B65D 25/08; B67B 7/26

[58] Field of Search ..... 128/218 M; 206/219, 206/222; 215/6, 307, 309, DIG. 8; 222/80, 83

[56] References Cited

UNITED STATES PATENTS

| | | | |
|---|---|---|---|
| 3,220,588 | 11/1965 | Lipari | 206/222 |
| 3,347,410 | 10/1967 | Schwartzman | 222/80 |
| 3,521,745 | 7/1970 | Schwartzman | 206/222 |
| 3,563,415 | 2/1971 | Ogle | 128/218 M |
| 3,766,917 | 10/1973 | Wimmer | 128/218 M |
| 3,802,604 | 4/1974 | Morane et al. | 222/83 |

*Primary Examiner*—Steven E. Lipman
*Attorney, Agent, or Firm*—Robert E. Burns; Emmanuel J. Lobato; Bruce L. Adams

[57] ABSTRACT

A dispenser and dispenser closure for storing two products separately in and on a necked container for eventual mixing thereof and dispensing them as a mixture. A sealed cup-shaped plug closes the container and has a bottom that is punchable or pierceable. The container contains a first material that is to be mixed with a second material contained in the cup-shaped plug externally of the container interior. A dispensing element which is a tubular punching piston is disposed slidable axially in the cup and is provided with a leading edge at an inner open end for punching or piercing the plug's bottom for introducing the second material into the container upon being depressed. The punching piston fixed therein coaxially therewith a dispensing tube open at both ends. A removable cover closes an outer end of the tube and removed therefrom automatically upon the punching piston being displaced. The mixtue contents are dispensed through the dispensing tube by first depressing the punching piston and then inverting the container once the mixture has been effected.

2 Claims, 4 Drawing Figures

DEVICE, PROVIDED WITH A PUNCHER AND A DRIPPER, FOR THE HERMETIC SEALING OF CONTAINERS

BACKGROUND OF THE INVENTION

The present invention relates to a closure for necked containers, equipped with a puncher and a dripper, hermetically sealing containers. Devices of the said type which are known and dispensers are likewise known which are capable of containing, separately, two diverse substances; of allowing, in a simple and fast manner, the mixing of substances and of dosing or dispensing mixture.

SUMMARY OF THE INVENTION

In accordance with the invention there is provided a closure device and a dispenser comprising, in combination, a container of glass or other material, apt to contain a substance, e.g. a liquid to be utilized as solvent; a receptacle - shaped or cup-shaped plug of plastic or other technologically suitable material, into which another substance is introduced, e.g. a powder, and which hermetically seals the container; means capable of boring or punching the bottom of the cup-shaped receptacle with subsequent introduction of the substance therein contained to the interior of the container filled with the other substance, and means capable of dosing or dispensing the solution resulting from the mixing of the various substances in such percentages as required by the consumer; and, last, a sealing cap or cover acting as actuating pushbutton.

Still according to the invention, these means of boring are formed by a hollow cylindrical sleeve or tubular punching piston made of plastic or other technologically suitable material, which airtightly slides on the internal cylindrical wall of the cup-shaped or plug receptacle. The cylindrical sleeve or tubular punching piston ends with a cutting edge at a short distance from the bottom of the receptacle and is provided, at the opposite end, with a disk connected with an internal dripper or dispensing tube or; this dripper of lesser diameter tube and disk too, are made of plastic or other technologically suitable material and into which dosing holes and the open-ended tube are bored; said holes are closed by a sealing cap made of plastic or other material and which receives airtightly, in a circular groove in the internal wall thereof the disk located at the top end of the sleeve which is equipped with a corresponding ring edge, located on the external wall.

BRIEF DESCRIPTION OF THE DRAWINGS

The present invention, so that it may be correctly understood and, accordingly, readily placed in practice, will now be described with reference to the accompanying drawings which illustrate one preferred embodiment of said invention by way of illustration and not of limitation.

DESCRIPTION OF THE PREFERRED EMBODIMENT

Figure 1:
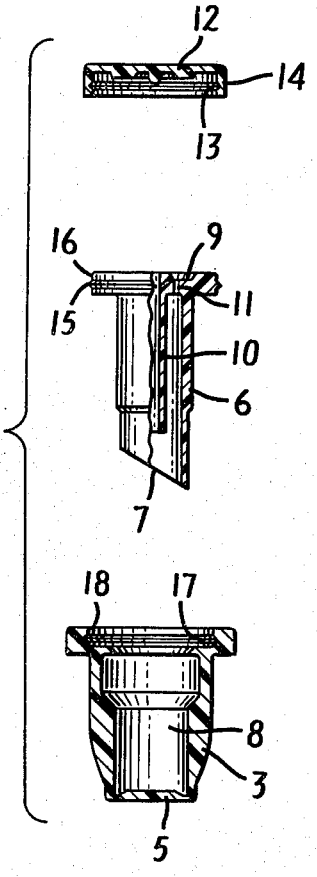
FIG. 1 is a sectional view showing the individual parts of the device according to the invention.
Figure 2:
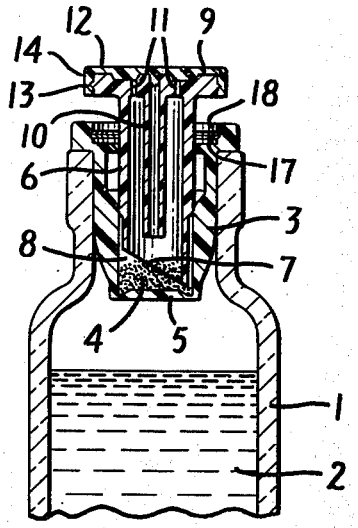
FIG. 2 is a sectional view showing the device in FIG. 1 inserted in a container prior to the mixing.
Figure 3:
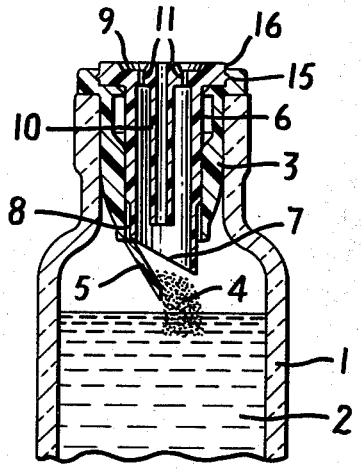
FIG. 3 is a view similar to FIG. 2, which shows the device during mixing action.
Figure 4:
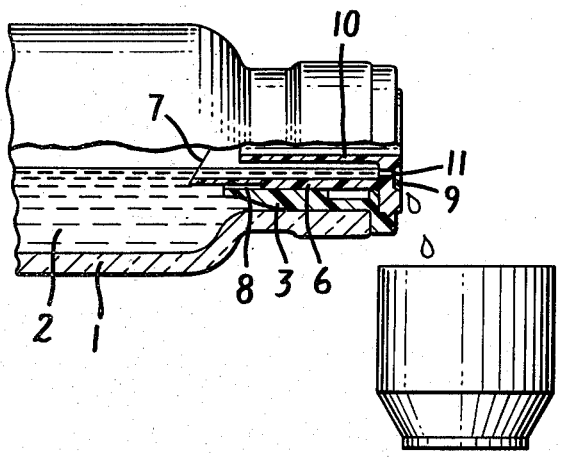
FIG. 4 is a view similar to FIG. 3, illustrating the device as it appears at the time of the use of the dripper.

In each figure, identical or corresponding parts of the device forming the object of the invention are indicated with the same reference numbers.

Referring to the drawings 1 is a container of glass or other material, in which a substance is contained, for instance a solvent liquid 2.

The container 1 is hermetically sealed with a dispenser closure having a receptacle-shaped or cup-shaped plug 3 of plastic or other technologically suitable material, in which another substance 4 has been placed, e.g. a powder, and whose bottom is constituted by a thin diaphragm, 5.

A hollow cylindrical sleeve or tubular punching piston 6 is installed within the receptacle - shaped plug 3. This sleeve is made of plastic or other technologically suitable material, and it is cut according to "a flute nib" that is according to an oblique plane, so as to form an inner cutting edge 7 located next to the diaphragm 5. The sleeve or tubular punching piston 6 can airtightly slide along the internal cylindrical wall 8 of the plug 3 and it has, at its top end, a disk 9 connected with an internal dripper portion and dispensing tube 10.

The dripper too is made of plastic or other technologically suitable material and into which dosing holes 11 are bored. Said holes are protected by a sealing cap 12 made of plastic or other material, which receives, airtightly, in a circular groove 13 of the internal wall 14, the disk 9 located at the top end of said sleeve 6 and which is provided with a corresponding ring edge 15 located on the external wall 16.

The use of the device above described is very simple: the user presses downward, with his finger, the sealing cap or cover 12 which, at the same time, operates as an actuating pushbutton; said pressure frees the sealing cap 12 from the sleeve 6 as soon as said sleeve 6 penetrates into the receptacle - shaped plug 3, which is provided with a circular groove 17 on the internal wall 18 corresponding to the ring edge 15 of the sleeve 6. Said penetration causes the boring or punching of the diaphragm 5 which forms the bottom of the plug 3 and the descent of the substance 4, placed in the plug 3, into the inside of the container 1 in which the substance 2 is contained.

Successively, the user mixes the two diverse substances shaking slightly the container equipped with the boring plug with the dripper. Then, the user gets the dose of the solution he requires holding the container inverted. The present invention has been described with reference to a preferred embodiment, but it is understood that variants in execution may be made in practice without going beyond the scope of the present patent disclosure.

I claim:

1. A dispensing closure for necked containers comprising a cup-shaped plug insertable and sealable into the neck of a necked container for closing it for containing therein a material to be introduced into the container for mixing with the contents of the container, said cup-shaped plug having a punchable and pierceable bottom, a dispensing element comprising a tubular punching piston inserted in use fluid-tightly axially into said cup-shaped plug and having an inner leading edge at an open inner end adjacent the bottom of the plug bottom for punching and piercing the bottom, said piston being depressable to effect punching and piercing of said bottom for introducing the material contained in the cupshaped plug into the container, a dispensing tube of lesser diameter than said tubular punching piston fixed in the tubular punching piston extending axially therein and having open ends for dispensing mixture contents of said container after depressing of said tubular punching piston and upon inverting of said container, a removable cover mounted in use on said tubular punching piston closing the outer open end of said dispensing tube, and said cover and said plug having surfaces disposed relative to each other for engaging and removing said cover when said tubular punching piston is depressed.

2. A dispensing closure for necked containers comprising a cup-shaped plug insertable and sealable into the neck of a necked container for closing it for containing therein a material to be introduced into the container for mixing with the contents of the container, said cup-shaped plug having a punchable and pierceable bottom, a dispensing element comprising a tubular punching piston inserted in use fluid-tightly axially into said cup-shaped plug and having an inner leading edge at an open inner end adjacent the bottom of the plug bottom for punching and piercing the bottom, said piston being depressable to effect punching and piercing of said bottom for introducing the material contained in the cup-shaped plug into the container, a dispensing tube of lesser diameter than said tubular punching piston fixed in the tubular punching piston extending axially therein and having open ends for dispensing mixture contents of said container after depressing of said tubular punching piston and upon inverting of said container, and said inner leading edge of said tubular punching piston being disposed and extending axially for engaging said bottom only along a marginal edge portion and punching and deflecting the bottom downwardly while a remainder marginal edge portion thereof remains fixed on said cup-shaped plug.

* * * * *